US009777943B2

(12) United States Patent
Hsiao

(10) Patent No.: US 9,777,943 B2
(45) Date of Patent: Oct. 3, 2017

(54) DRAINAGE DEVICE WITH A LOW-NOISE DRAINAGE SHELL FOR AIR-CONDITIONING EQUIPMENT

(71) Applicant: HOLIMAY CORPORATION, Bade, Taoyuan County (TW)

(72) Inventor: Yu-Ming Hsiao, Bade (TW)

(73) Assignee: HOLIMAY CORPORATION, Bade, Taoyuan County (TW)

( * ) Notice: Subject to any disclaimer, the term of this patent is extended or adjusted under 35 U.S.C. 154(b) by 643 days.

(21) Appl. No.: 14/321,585

(22) Filed: Jul. 1, 2014

(65) Prior Publication Data

US 2015/0276300 A1 Oct. 1, 2015

(30) Foreign Application Priority Data

Mar. 31, 2014 (TW) ..... 103205558 U

(51) Int. Cl.
*F24F 13/24* (2006.01)
*F25D 21/14* (2006.01)
*F24F 13/22* (2006.01)

(52) U.S. Cl.
CPC ..... *F24F 13/222* (2013.01)

(58) Field of Classification Search
CPC ..... F24F 13/24; F24D 1/56; F25D 21/14
USPC ..... 62/272
See application file for complete search history.

(56) References Cited

U.S. PATENT DOCUMENTS 2,012 A * 3/1841 Kanel ..... B27B 11/00 222/184
4,562,016 A * 12/1985 Colliver ..... F24F 6/04 134/186
5,894,737 A * 4/1999 Haeck ..... B60H 1/3233 165/42
6,039,532 A * 3/2000 McConnell ..... F04D 29/422 415/119
6,322,326 B1 * 11/2001 Davis ..... F04D 13/08 417/279
7,252,482 B2 * 8/2007 Walker ..... F04D 29/588 310/63

(Continued)

FOREIGN PATENT DOCUMENTS

JP 2003293976 A * 10/2003
TW 517828 U1 * 1/2003
TW M307732 3/2007

*Primary Examiner* — Len Tran
*Assistant Examiner* — Jenna M Hopkins
(74) *Attorney, Agent, or Firm* — Muncy, Geissler, Olds & Lowe, P.C.

(57) ABSTRACT

A drainage device with a low-noise drainage shell for air-conditioning equipment is disclosed to include a housing, a motor, a radiating fan, a drainage shell, and a drainage blade. The motor is mounted in the housing. The radiating fan is mounted in the housing above the motor. The drainage shell mounted in the housing and has a drainage partition block extended from an inside wall thereof to divide the inside space of the drainage shell into an accommodation trough and a drainage trough in communication with each other. The drainage partition block has a backwardly upwardly tilted sloping surface. Thus, the sloping surfaces of the drainage partition block can guide the drain water smoothly to the drainpipe to reduce the water resistance, thereby significantly reducing the level of water drain noise.

3 Claims, 4 Drawing Sheets

(56) References Cited

U.S. PATENT DOCUMENTS

| | | | | |
|---|---|---|---|---|
| 8,683,821 | B2 * | 4/2014 | Volk | B01D 29/15 62/291 |
| 9,243,395 | B2 * | 1/2016 | Dal Canto | E03F 5/22 |
| 2009/0053073 | A1 * | 2/2009 | Ward | F04D 15/0218 417/40 |

* cited by examiner

DRAINAGE DEVICE WITH A LOW-NOISE DRAINAGE SHELL FOR AIR-CONDITIONING EQUIPMENT

BACKGROUND OF THE INVENTION

1. Field of the Invention

The present invention relates to air conditioning drains and more particularly, to a drainage device with a low-noise drainage shell for air-conditioning equipment.

2. Description of the Related Art

Taiwan patent M307732 discloses a low-vibration drainage device for air-conditioning equipment, wherein an drainage partition block extends from a inner wall of a drainage chamber and gradually reduces in width toward the distal end thereof and terminates in a pointed tip to divide the inside space of the drainage chamber into an accommodation trough and a drainage trough in communication with each other; a drainage blade located in the accommodation trough and rotatable to expel water out of the accommodation trough toward the drainage trough for discharge through a drainage pipe.

Because the distal end of the drainage partition block of the aforesaid prior art design is a pointed tip, it will disturb the induced flow of water during rotation of the drainage blade, causing noises.

SUMMARY OF THE INVENTION

The present invention has been accomplished under the circumstances in view. It is the main object of the present invention to provide a drainage device with a low-noise drainage shell for air-conditioning equipment, which has the drainage partition block having the width thereof gradually reducing in direction away from the inside wall of the drainage shell to have two opposite lateral sides thereof terminate in a backwardly upwardly tilted sloping surface to reduce drainage sound.

To achieve this and other objects of the present invention, a drainage device with a low-noise drainage shell for air-conditioning equipment comprises a housing, which comprises a bottom shell and a cover shell that has a plurality of vent holes spaced around the periphery thereof, a motor mounted in said cover shell of the housing and having a driving shaft, a radiating fan mounted in the cover shell above the motor, a drainage shell, which is mounted in the bottom shell with a concave thereof facing upward and comprises a drainage partition block inwardly extended from an inside wall thereof to divide the inside space of the drainage shell into an accommodation trough and a drainage trough in communication with each other, the drainage partition block having the width thereof gradually reducing in direction away from the inside wall of the drainage shell to have two opposite lateral sides thereof terminate in a backwardly upwardly tilted sloping surface, a drainage blade mounted in the accommodation trough of the drainage shell, and the driving shaft mounted in said housing and axially inserted through the center of said radiating fan and the center of said motor and the center of said drainage blade and connected therewith for synchronous rotation. Thus, the sloping surface of the drainage partition block can guide the water to the drain to reduce water resistance, thereby reducing water drain noise.

Other advantages and features of the present invention will be fully understood by reference to the following specification in conjunction with the accompanying drawings, in which like reference signs denote like components of structure.

DETAILED DESCRIPTION OF THE INVENTION

Figure 1:
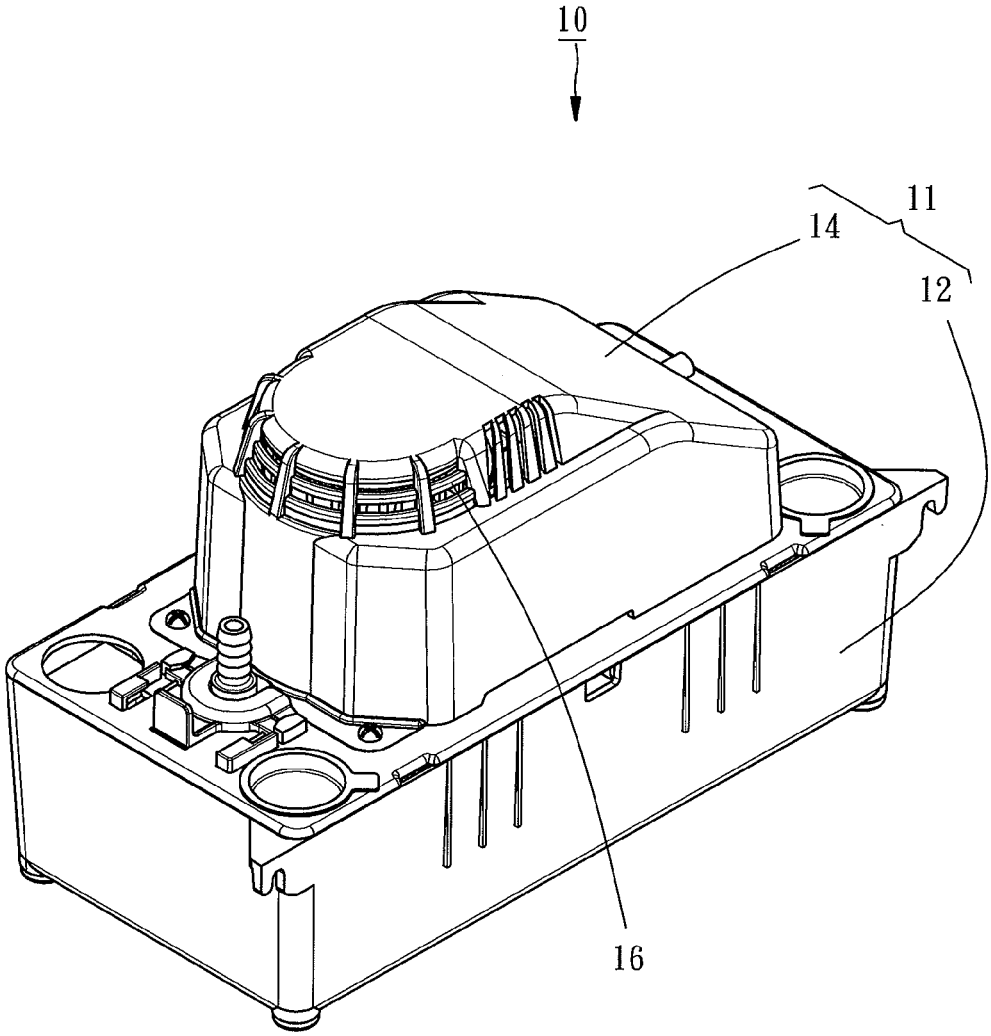
FIG. 1 is an oblique top elevational view of a drainage device with a low-noise drainage shell for air-conditioning equipment in accordance with the present invention.

Referring to FIGS. 1-4, a drainage device with a low-noise drainage shell for air-conditioning equipment in accordance with the present invention is shown. As illustrated, the drainage device 10 comprises a housing 11, a motor 21, a radiating fan 31, a drainage shell 41, a drainage blade 51.

The housing 11 comprises a bottom shell 12 and a cover shell 14. The cover shell 14 has a plurality of vent holes 16, as shown in FIG. 1.

Figure 2:
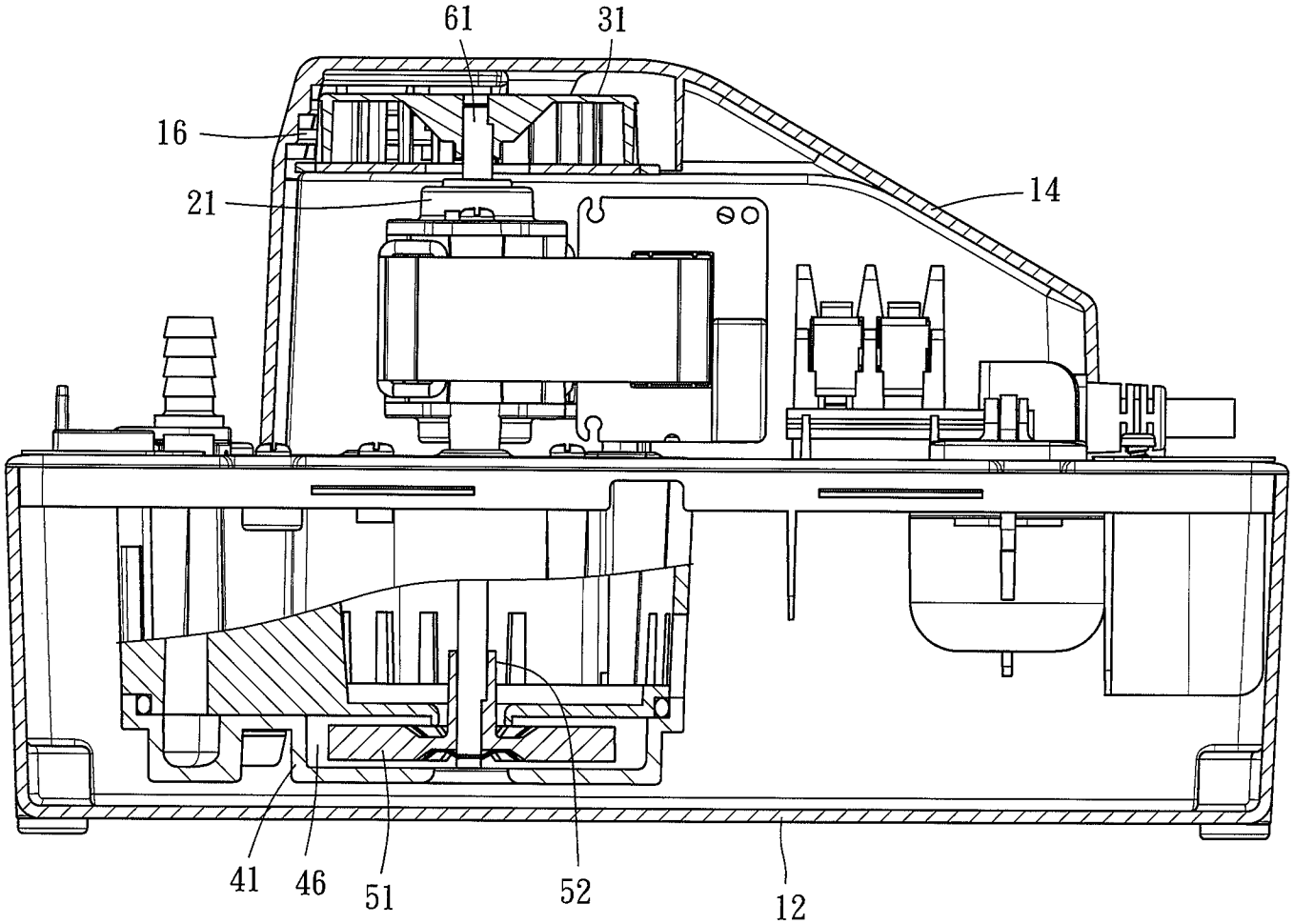
FIG. 2 is an enlarged sectional view of the drainage device shown in FIG. 1, illustrating the arrangement of the housing, motor, radiating fan, drainage shell, drainage blade and driving shaft.

The motor 21 is mounted in the cover shell 14 inside the housing 11, as shown in FIG. 2. The motor 21 has a driving shaft 61.

The radiating fan 31 is mounted in the cover shell 14 inside the housing 11, and disposed above the motor 21.

Figure 3:
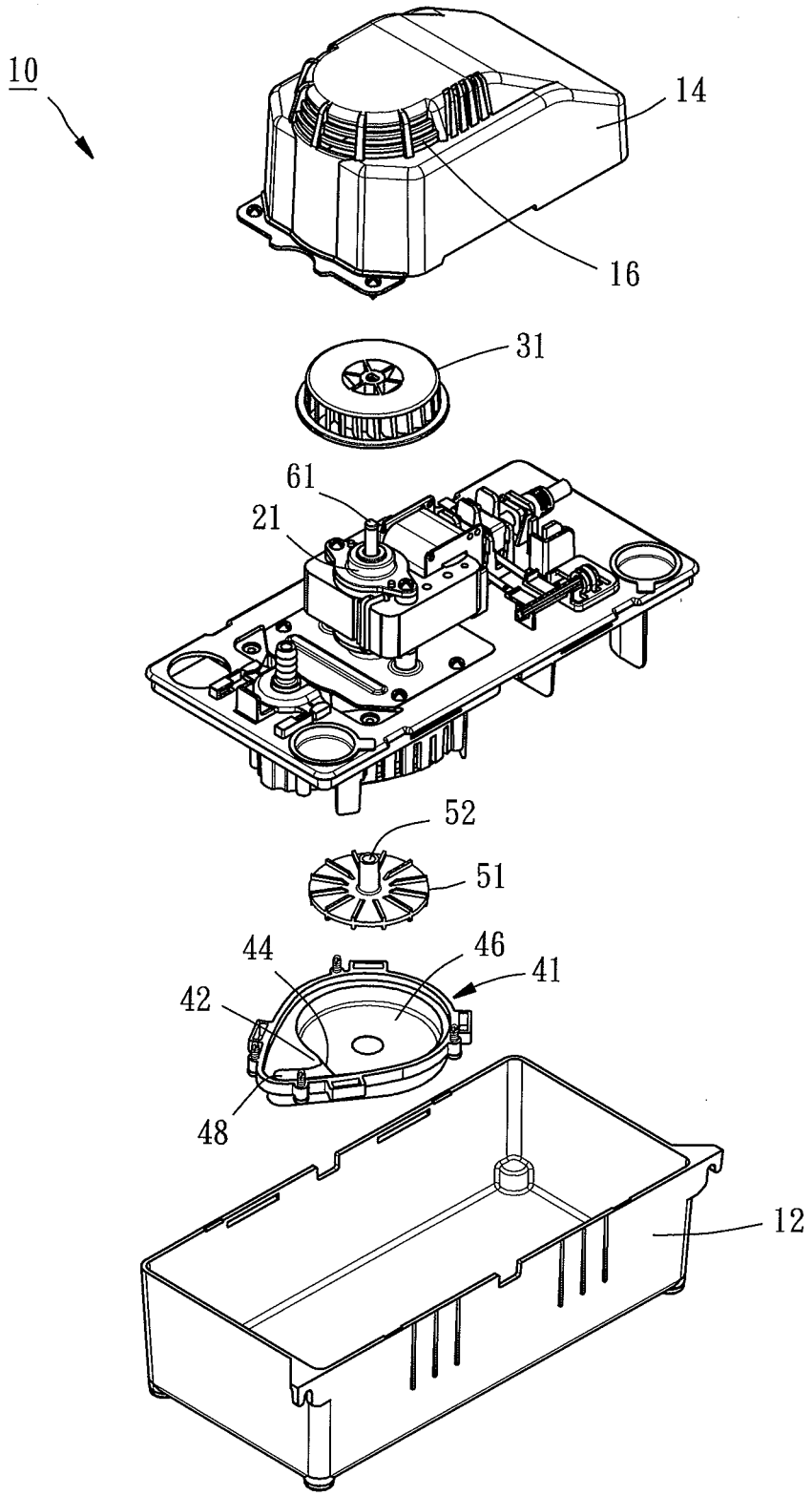
FIG. 3 is an exploded view of the housing, motor, radiating fan, drainage shell, drainage blade and driving shaft of the drainage device with a low-noise drainage shell for air-conditioning equipment in accordance with the present invention.
Figure 4:
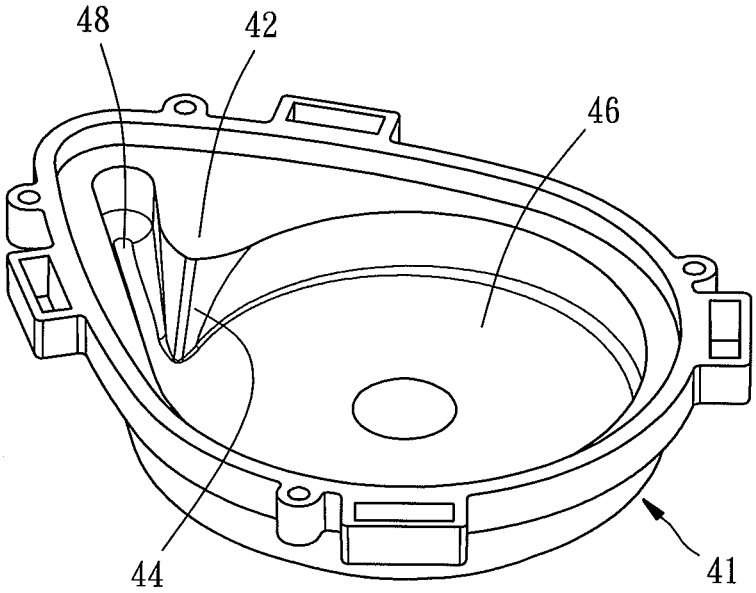
FIG. 4 is an oblique top elevational view of the drainage shell of the drainage device with a low-noise drainage shell for air-conditioning equipment in accordance with the present invention, illustrating the transversely arched configuration of the sloping surface of the drainage partition block.

The drainage shell 41 is mounted in the bottom shell 12 with a concave thereof facing upward, as shown in FIGS. 2 and 3. The drainage shell 41 has a drainage partition block 42 inwardly extended from an inside wall thereof, as shown in FIG. 4. The drainage partition block 42 has the width thereof gradually reducing in direction away from the inside wall of the drainage shell 41 to have two opposite lateral sides thereof terminate in a backwardly upwardly tilted sloping surface 44. Further, the drainage partition block 42 divides the inside space of the drainage shell 41 into an accommodation trough 46 and a drainage trough 48, wherein the accommodation trough 46 and the drainage trough 48 are disposed in communication with each other. In this embodiment, the backwardly upwardly tilted sloping surface 44 is transversely smoothly arched.

The drainage blade 51 is mounted in the accommodation trough 46 of the drainage shell 41, as shown in FIGS. 2 and 3. In this embodiment, the drainage blade 51 comprises an axle sleeve 52 axially located at the center thereof.

The driving shaft 61 is mounted in the housing 11, as shown in FIG. 2, and axially inserted through the center of the radiating fan 31, the center of the motor 21 and the axle sleeve 52 of the drainage blade 51 for synchronous rotation.

After understanding the structural details of the drain device, the operation of the drain device is outlined hereinafter.

Figure 5:
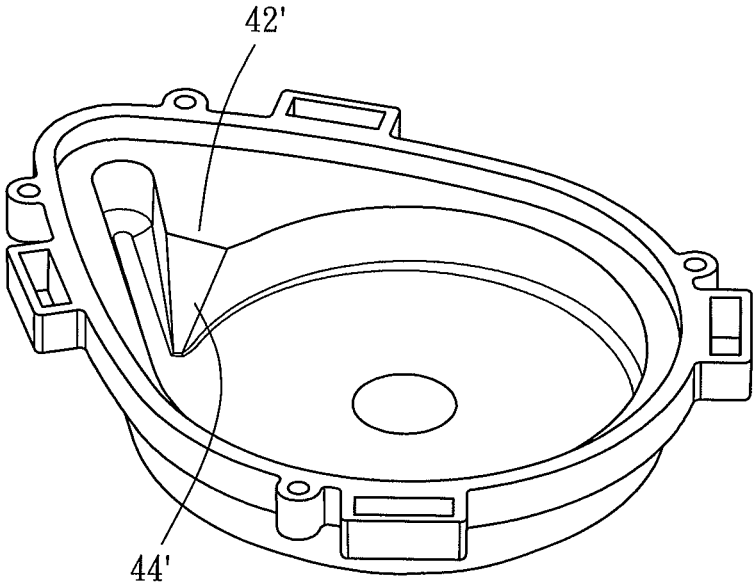
FIG. 5 is an oblique top elevational view of an alternate form of the drainage shell of the drainage device with a low-noise drainage shell for air-conditioning equipment in accordance with the present invention, illustrating the chamfered configuration of the sloping surface of the drainage partition block.

Referring to FIG. 2 again, when draining the water, the motor 21 is controlled to rotate the driving shaft 61, thereby driving the drainage blade 51 to expel water from the accommodation trough 46 toward the drainage trough 48, as shown in FIG. 4. At this time, the propelled flow of water flows over the sloping surface 44 of the drainage partition block 42. The sloping surface 44 is transversely smoothly arched. The sloping surface 44 guide the drain water smoothly to the drainpipe (not shown) to reduce the water resistance, thereby significantly reducing the level of water drain noise. Further, in an alternate form of the present invention as shown in FIG. 5, the sloping surface 44' of the drainage partition block 42' is chamfered. The sloping surface 44' can also effectively guide the drain water smoothly to the drainpipe to reduce the water resistance, thereby significantly reducing the level of water drain noise. However, it is to be noted that the configuration of the sloping surface 44' is not limited to the shape illustrated in the drawing.

As stated above, the invention achieves the effect of overcoming the problem of high water drain noise of the prior art design. The sloping surface 44, 44' of the drainage partition block 42 can guide the drain water smoothly to the drainpipe to reduce the water resistance, thereby significantly reducing the level of water drain noise.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A drainage device with a drainage shell for air-conditioning equipment, comprising:

a housing comprising a bottom shell and a cover shell, said cover shell comprising a plurality of vent holes spaced around the periphery thereof;

a motor mounted in said cover shell of said housing and having a driving shaft;

a radiating fan mounted in said cover shell above said motor;

a drainage shell is mounted in said bottom shell with a concave thereof facing upward, said drainage shell comprising a drainage partition block inwardly extended from an inside wall thereof to divide the inside space of said drainage shell into an accommodation trough and a drainage trough in communication with each other, said drainage partition block having the width thereof gradually reducing in direction away from the inside wall of said drainage shell to have two opposite lateral sides thereof terminate in a backwardly upwardly tilted sloping surface; and a drainage blade mounted in said accommodation trough of said drainage shell, wherein the driving shaft is mounted in said housing and axially inserted through the center of said radiating fan and the center of said motor and the center of said drainage blade and connected therewith for synchronous rotation, and wherein said sloping surface is formed at a distal end of said drainage partition block, and said sloping surface backwardly upwardly extends relative to the drainage shell in a way that said sloping surface has a width gradually upwardly increasing.

2. The drainage device as claimed in claim 1, wherein said sloping surface is transversely arched.

3. The drainage device as claimed in claim 1, wherein said sloping surface is chamfered.

* * * * *